US008046150B2

(12) United States Patent
Anilovich et al.

(10) Patent No.: US 8,046,150 B2
(45) Date of Patent: Oct. 25, 2011

(54) ENGINE COOLING SYSTEM DIAGNOSTIC FOR APPLICATIONS WITH TWO COOLANT SENSORS

(75) Inventors: Igor Anilovich, Walled Lake, MI (US); John W. Siekkinen, Novi, MI (US); Jinhee Yu, Farmington Hills, MI (US); Zhong Wang, Bellevue, WA (US); Mikaela Waller, Stockholm (SE)

(73) Assignee: GM Global Technology Operations LLC

( * ) Notice: Subject to any disclaimer, the term of this patent is extended or adjusted under 35 U.S.C. 154(b) by 386 days.

(21) Appl. No.: 12/409,791

(22) Filed: Mar. 24, 2009

(65) Prior Publication Data

US 2010/0138134 A1 Jun. 3, 2010

Related U.S. Application Data

(60) Provisional application No. 61/118,743, filed on Dec. 1, 2008.

(51) Int. Cl.
*F02D 45/00* (2006.01)
*F01P 7/16* (2006.01)

(52) U.S. Cl. ..... 701/102; 123/41.31

(58) Field of Classification Search ..... 701/102, 701/101, 115; 123/41.01, 41.05, 41.31
See application file for complete search history.

(56) References Cited

U.S. PATENT DOCUMENTS 4,450,694 A * 5/1984 Matsuda et al. ..... 66/193
7,168,398 B2 * 1/2007 Ap et al. ..... 123/41.1

* cited by examiner

*Primary Examiner* — Hieu T Vo

(57) ABSTRACT

A temperature comparison module generates a temperature difference between an engine coolant temperature and a radiator coolant temperature. An energy determination module determines an energy value corresponding to heat energy generated by an engine. The heat energy increases at least one of the engine coolant temperature and the radiator coolant temperature. A diagnostic module generates a comparison of the temperature difference and the energy value and determines a status of a thermostat associated with the engine based on the comparison.

12 Claims, 3 Drawing Sheets

ENGINE COOLING SYSTEM DIAGNOSTIC FOR APPLICATIONS WITH TWO COOLANT SENSORS

CROSS-REFERENCE TO RELATED APPLICATIONS

This application claims the benefit of U.S. Provisional Application No. 61/118,743, filed on Dec. 1, 2008. The disclosure of the above application is incorporated herein by reference.

FIELD

The present disclosure relates to diagnosis of an engine cooling system and more particularly to diagnosis of an engine cooling system with two coolant sensors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An engine combusts a mixture of air and fuel in a combustion process to produce a drive torque. During the combustion process, the engine converts chemical potential energy of the air/fuel mixture into kinetic energy and heat energy. A portion of the heat energy may be transferred to a coolant mass (m) circulating through the engine.

The heat energy may cause a coolant temperature of the coolant mass (m) to increase. The coolant temperature may be measured by an engine coolant temperature (ECT) sensor at a location inside the engine. The ECT sensor sends the ECT to an engine control module (ECM).

A thermostat may regulate the amount of the coolant mass (m) circulating through the engine. The thermostat is a thermostatic valve that opens when the coolant temperature reaches a thermostat opening temperature and closes when the coolant temperature is below the opening temperature. While the thermostat is closed, the coolant mass (m) circulating through the engine is smaller than when the thermostat is open.

Normally when the coolant temperature is below the opening temperature, the thermostat is closed so that the coolant mass (m) circulating through the engine is smaller. The heat energy transfers to the smaller coolant mass (m) and increases the ECT to an operating range. The operating range may be a coolant temperature range of approximately 180° F. to 200° F. Once the ECT is within the operating range, the thermostat may subsequently open to increase the amount of the coolant mass (m) circulating through the engine and regulate the coolant temperature.

A stuck open thermostat occurs when the thermostat remains stuck open regardless of the coolant temperature. The stuck open thermostat may delay or prevent the ECT from increasing to the operating range by allowing the coolant mass (m) circulating through the engine to be larger. The heat energy is transferred to a larger coolant mass, which results in a slower coolant temperature increase. The coolant temperature is therefore below the operating range for a longer period than when the coolant mass (m) is smaller.

While the coolant temperature is below the operating range, lubricating liquids inside the engine may be less effective and components of the engine may wear out faster. The combustion process may be less efficient and fuel vaporization may be less effective. The exhaust emissions may emit more pollutants. When the coolant temperature is in the operating range, the engine operates in more favorable conditions for fuel vaporization, engine lubrication, and exhaust emissions.

A coolant temperature model may be used to determine when the thermostat is stuck open. For example, a modeled ECT may be compared to the sensed ECT to determine when the thermostat is stuck open. When the difference between the modeled ECT and the sensed ECT is large enough, the thermostat may be stuck open. The model may be inaccurate and may require a lengthy period to diagnose the stuck open thermostat. In addition, multiple coolant temperature models may be required for multiple engines and cooling systems.

SUMMARY

An engine control system comprises a temperature comparison module, an energy determination module, and a diagnostic module. The temperature comparison module compares a first coolant temperature and a second coolant temperature of a mass of coolant in an engine cooling system of an engine. The energy determination module determines a calculated energy converted during a combustion process in the engine. The diagnostic module sets a stuck open failure status of a thermostat disposed in the engine cooling system based on the temperature comparison and the calculated energy.

In other features, the first coolant temperature is measured by an engine coolant temperature sensor in the engine. The second coolant temperature is measured by a radiator coolant temperature sensor in a radiator in the cooling system. The thermostat is between the engine and the radiator. The calculated energy is based on a mass of air entering the engine.

The engine control system further comprises an adjustment module that determines an adjustment factor that modifies the calculated energy. The adjustment factor is an exponential modifier of the calculated energy. The adjustment factor can be a calibrateable value equal to 0.6. In other features, the adjustment factor is based on the mass of coolant in the cooling system. In yet other features, the adjustment factor is based on an operating condition of the engine.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
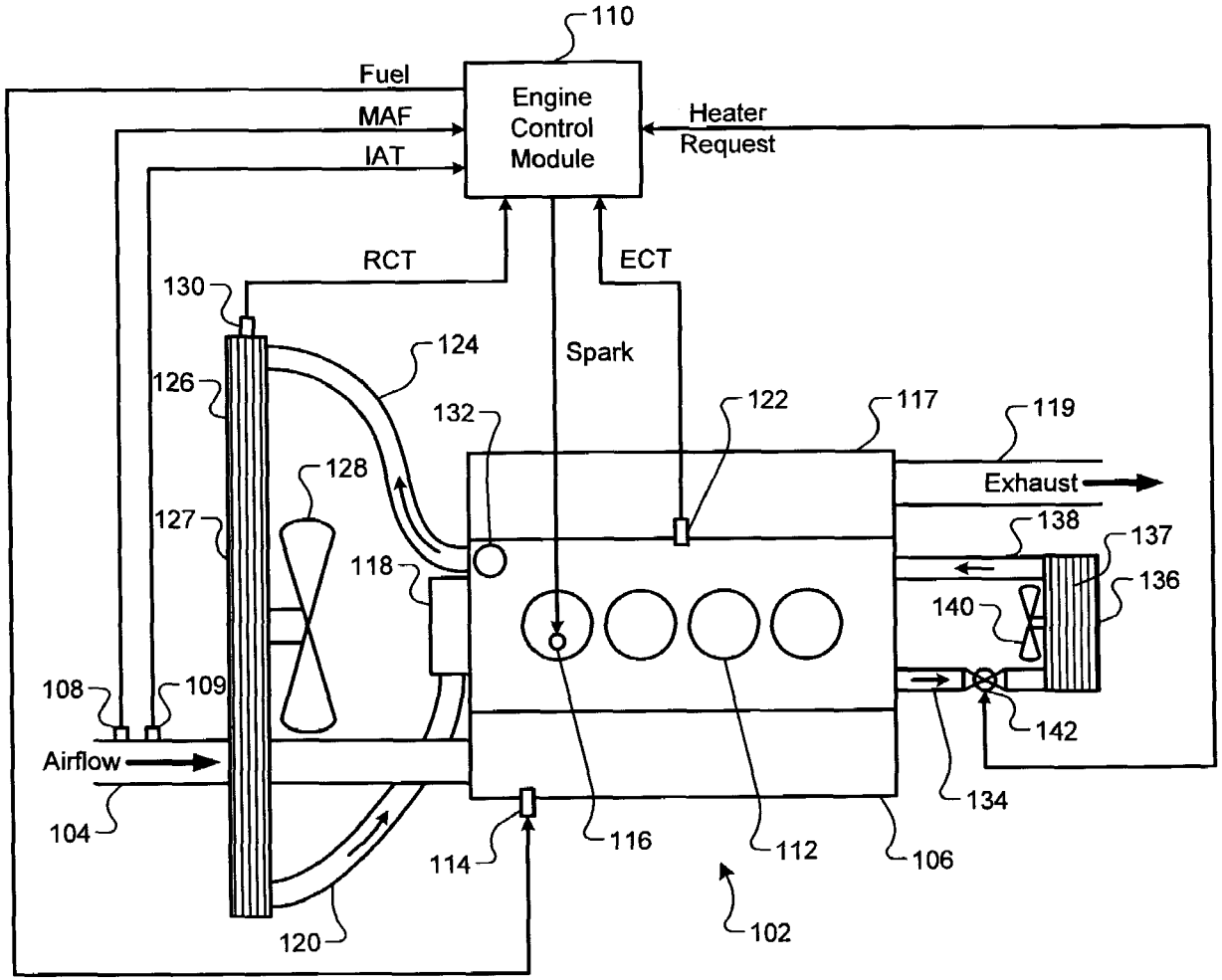
FIG. 1 is a functional block diagram of an exemplary implementation of an engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

The engine control system according to the present disclosure uses two coolant temperatures to diagnose the stuck open thermostat. A first coolant temperature may be measured by an engine coolant temperature (ECT) sensor at a location in an engine. A second coolant temperature may be measured by a radiator coolant temperature (RCT) sensor at a location in a radiator. The thermostat may be located between the engine and the radiator.

A temperature difference between the ECT and the RCT may be compared with a calculated energy corresponding to a chemical energy of an air/fuel mixture converted during the combustion process. A temperature-energy ratio of the temperature difference and the calculated energy may be compared with a failure threshold to diagnose when the thermostat is stuck open. While the thermostat is closed, the ratio will be greater than or equal to a failure threshold. While the thermostat is stuck open, the ratio will be less than the failure threshold.

Referring now to FIG. 1, an exemplary implementation of an internal combustion engine system is shown. Air enters an engine 102 through an air inlet 104 and travels to an intake manifold 106. A manifold airflow (MAF) sensor 108 may be disposed in the inlet 104. The MAF sensor 108 generates an airflow signal based on a mass of the air entering the engine 102 and communicates the airflow signal with an engine control module (ECM) 110. An intake air temperature (IAT) sensor 109 may also be disposed in the inlet 104 to measure a temperature of the air.

The intake manifold 106 distributes the air to cylinders 112. A fuel injector 114 may inject a mass of fuel into the intake manifold 106 at a central location or at multiple locations. Alternatively, the fuel injector 114 may inject the fuel directly into the cylinders 112. In a gasoline engine, the fuel mass may be based on the airflow signal generated by the MAF sensor 108. The air and the fuel are chemical reactants that mix to create an air/fuel mixture having a chemical potential energy.

Pistons (not shown) within the cylinders 112 compress the air/fuel mixture. In a gasoline engine, a spark plug 116 may ignite the air/fuel mixture during the combustion process. In a diesel or compression ignition engine, the air/fuel mixture may be ignited by compression in the cylinder 112. The principles of the present disclosure may be applied to both gasoline and diesel engines.

The combustion of the air/fuel mixture increases the pressure in the cylinder 112 and forces a piston (not shown) to drive a crankshaft (not shown) in the engine. In this manner, a portion of the chemical energy is converted into kinetic energy to produce a drive torque.

Another portion of the chemical energy is converted into heat energy. The heat energy may be transferred to the exhaust gas that exits the cylinders 112 through an exhaust manifold 117 to an exhaust pipe 119. The exhaust gas may transfer some of the heat energy to the exhaust manifold 117 and the exhaust pipe 119. The heat energy may also be transferred from the cylinders 112 to a coolant mass (m) circulating through coolant passages (not shown) in the engine 102. The coolant mass (m) may be a liquid coolant that flows through a cooling system.

The cooling system may include a water pump 118 that pumps the coolant mass (m) into the engine 102 from an inlet hose 120. The water pump 118 can be a centrifugal pump disposed within the engine 102. The water pump 118 can be powered by the crankshaft (not shown) through a connection to a belt and pulley system connected to the crankshaft. The water pump 118 can also be powered by an electric motor (not shown). The water pump 118 circulates the coolant mass (m) through the coolant passages inside the engine 102. The heat energy from the combustion process transfers to the coolant mass (m), causing the coolant temperature to increase. An engine coolant temperature (ECT) sensor 122 disposed in the engine 102 measures the coolant temperature and communicates the ECT to the ECM 110.

The water pump 118 may continue to circulate the coolant mass (m) through an outlet hose 124 to a radiator 126 in the cooling system. The radiator 126 may include multiple elongated channels 127 inside of which the coolant mass (m) may flow. The radiator 126 acts as a heat exchanger and allows the heat energy from the coolant mass (m) to transfer to air flowing outside of the channels 127. A cooling fan 128 may blow the air through the radiator 126 to increase the heat transferred from the coolant mass (m) to the air.

The flow of air through the radiator 126 may cause the coolant temperature to decrease before the coolant mass (m) exits the radiator 126 through the inlet hose 120. Some of the heat energy from the coolant mass (m) transfers to the air, causing the coolant temperature to decrease. A radiator coolant temperature (RCT) sensor 130 disposed in the radiator 126 measures the coolant temperature and communicates the RCT to the ECM 110.

A thermostat 132 may be disposed in the cooling system between the engine 102 and the radiator 126. For example, the thermostat 132 may be attached to the engine 102 or disposed in the outlet hose 124. The thermostat 132 may be a thermostatic valve that opens when the coolant at the thermostat 132 reaches a thermostat opening temperature. The thermostat 132 regulates the coolant mass (m) circulating through the engine 102 by opening and closing based on the coolant temperature. The thermostat 132 may be a heated thermostat 132 including an electrical heating element (not shown) to lower the opening temperature of the thermostat 132.

While the coolant at the thermostat 132 is below the opening temperature, the thermostat 132 may be closed. The closed thermostat 132 separates the coolant mass (m) into an engine coolant mass ($m_e$) and a radiator coolant mass ($m_r$) by blocking the flow of coolant from the engine 102 to the radiator 126. The engine coolant mass ($m_e$) is a mass of coolant inside the engine 102. The radiator coolant mass ($m_r$) is a mass of coolant inside the radiator 126 and may include the mass of coolant in the inlet hose 120 and the outlet hose 124. By blocking the flow of coolant from the engine 102 to the radiator 126, the thermostat 132 causes the coolant mass (m) circulating through the engine 102 to be smaller than if the radiator coolant mass ($m_r$) was included.

While the coolant at the thermostat 132 is above the opening temperature, the thermostat 132 may subsequently open to allow the coolant mass (m) circulating through the engine 102 to include the radiator coolant mass ($m_r$). Therefore, the engine coolant mass ($m_e$) and radiator coolant mass ($m_r$) combine to form increase the coolant mass (m) circulating through the engine 102.

The water pump 118 may also circulate the coolant mass (m) through a heater inlet 134 to a heater core 136. The heater core 136 may include multiple elongated channels 137 inside of which the coolant mass (m) may flow. The heater core 136 acts as a heat exchanger and allows the heat energy from the coolant mass (m) to transfer to air flowing outside the channels 137. A fan 140 may blow the air through the heater core 136 to increase the heat transferred from the coolant to the air. The air may be used to increase a temperature of an interior of a vehicle. The flow of air through the heater core 136 may decrease the coolant temperature before the coolant mass (m) exits the heater core 136 through the heater outlet 138.

A heater valve 142 may be disposed between the heater core 136 and the heater inlet 134. The heater valve 142 may open and close in response to a heater request. The heater request may be provided in response to control by an occupant of the vehicle or by the ECM 110.

While the heater request is not present, the heater valve 142 may be closed to prevent the coolant mass (m) circulating through the engine 102 from including a heater coolant mass ($m_h$). The heater coolant mass ($m_h$) is a mass of coolant inside the heater core 136 and may include the mass of coolant in the heater inlet 134 and the heater outlet 142. By blocking the flow of coolant from the engine 102 to the heater core 136, the heater valve 142 forces the heater coolant mass ($m_h$) to remain inside the heater core 136. The coolant mass (m) circulating through the engine 102 is thus smaller than if the heater coolant mass ($m_h$) were included.

While the heater request is present, the heater valve 142 opens to allow the coolant mass (m) circulating through the engine 102 to include the heater coolant mass ($m_h$). The coolant mass (m) may flow through the heater core 136 where a portion of the heat energy may transfer to the air flowing through the heater core 136 into the interior of the vehicle. The coolant mass (m) circulating inside the engine 102 is thus larger with the heater coolant mass ($m_h$) included.

During the combustion process, the heat energy transferred from the cylinders 112 to the coolant mass (m) causes the coolant temperature to change at the ECT sensor 122. Ideally, the temperature change and heat energy are directly proportional based on:

$$Q=m\times c\times(T-T_0)$$

where (Q) is the heat energy transferred to the coolant, (m) is the coolant mass to which the heat energy is transferred, (c) is the specific heat capacity of the coolant (a constant), and ($T-T_0$) is the change in the coolant temperature (T) from an initial coolant temperature ($T_0$).

The coolant mass (m) may increase or decrease depending on the thermostat 132 and the heater valve 142. For example, while the thermostat 132 is closed and the heater valve 142 is closed, the coolant mass (m) circulating through the engine 102 may only include the engine coolant mass ($m_e$). When the thermostat 132 opens, the coolant mass (m) may include the engine coolant mass ($m_e$) and the radiator coolant mass ($m_r$). While the heater valve 142 is open, the coolant mass may also include the heater coolant mass ($m_h$). The larger the coolant mass (m) is, the slower the change in ECT. Therefore, the change in ECT may be effected by the coolant mass (m).

Normally, while the coolant temperature is below the opening temperature, the thermostat 132 remains closed so that the radiator coolant mass ($m_r$) is not included in the coolant mass (m) circulating inside the engine 102. The ECT may increase more quickly because less coolant mass (m) is circulating through the engine 102 to transfer heat energy from the combustion process than if the radiator coolant mass ($m_r$) were included.

The heater valve 142 may be open or closed depending on the heater request. While the heater valve 142 is closed, the coolant mass (m) may only include the engine coolant mass ($m_e$). The heat energy from the combustion process is transferred to the smaller engine coolant mass ($m_e$), which results in a more rapid ECT increase. While the heater valve 142 is open, the coolant mass (m) may also include the heater coolant mass ($m_h$). The heat energy from the combustion process is transferred to both the engine coolant mass ($m_e$) and the heater coolant mass ($m_h$), which may cause the ECT to increase more slowly.

While the thermostat 132 is closed, the radiator coolant mass ($m_r$) is not circulating through the engine 102. Little or no heat energy from the combustion process transfers to the radiator coolant mass ($m_r$). The RCT may remain substantially constant while the thermostat 132 is closed because the RCT sensor 130 measures the coolant temperature inside the radiator 126. The RCT may be approximately equal to an initial temperature of the ECT. Therefore, while the thermostat is closed, the difference between the ECT and the RCT increases.

When the coolant temperature reaches the opening temperature, the thermostat 132 opens to allow the coolant mass (m) circulating through the engine 102 to include the radiator coolant mass ($m_r$). The ECT and the RCT may reach an equilibrium due to mixing of the engine coolant mass ($m_e$) and the radiator coolant mass ($m_r$). The difference between the ECT and the RCT may become constant.

When the combustion process ends, the coolant temperature decreases because no heat energy is transferred to the coolant mass (m). Normally, the thermostat 132 closes when the coolant temperature decreases below the opening temperature.

When the thermostat 132 fails to close after the coolant temperature decreases below the opening temperature, the thermostat 132 is stuck open. The thermostat 132 may remain stuck open due to a failed component of the thermostat 132 or an obstruction in the opening of the thermostat 132. During the combustion process, the coolant mass (m) circulating through the engine 102 includes a combination of the radiator coolant mass ($m_r$) and the engine coolant mass ($m_e$), regardless of the coolant temperature.

The ECT increases more slowly when the coolant mass (m) includes the radiator coolant mass ($m_r$). The larger the coolant mass (m) is, the more slowly the ECT increases to the operating range. In addition, the RCT and ECT may rise at substantially the same rate because the coolant mass (m) flows through both the engine 102 and the radiator 126. The ECT sensor 122 and the RCT sensor 130 measure the temperature of the same coolant mass (m) instead of the engine coolant mass ($m_e$) and the radiator coolant mass ($m_r$) respectively. Therefore, while the thermostat 132 is stuck open, the difference between ECT and RCT remains substantially constant.

Figure 2:
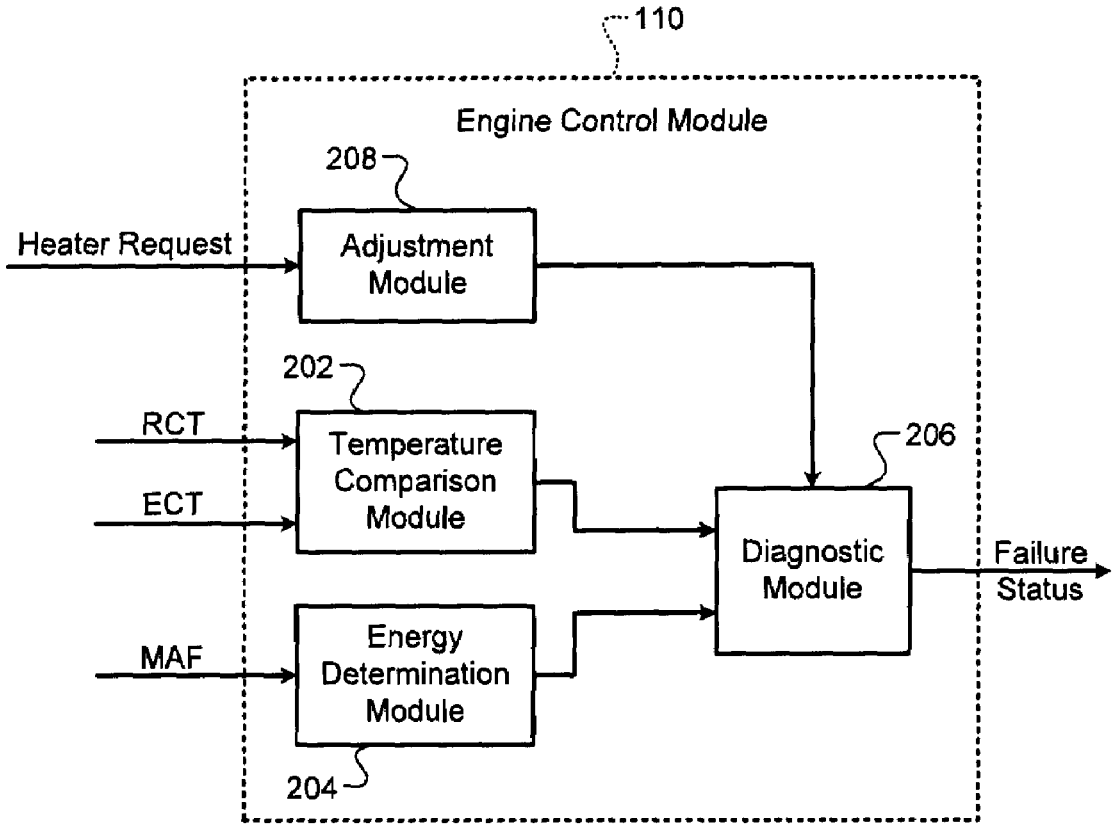
FIG. 2 is a functional block diagram of an exemplary implementation of an engine control module according to the principles of the present disclosure.

Referring now to FIG. 2, an exemplary implementation of the ECM 110 is shown. The engine control module includes a temperature comparison module 202, an energy determination module 204, a diagnostic module 206, and an adjustment module 208.

The temperature comparison module 202 receives the temperature signals from the ECT sensor 122 and the RCT sensor 130. The temperature comparison module 202 compares the signals and outputs a temperature delta ($\Delta T$) by subtracting the RCT from the ECT.

The energy determination module 204 determines a calculated energy (E) converted during the combustion process. The calculated energy (E) may be based on an accumulated mass airflow from the MAF sensor 108. The accumulated mass airflow may be an integral of the mass of air entering the engine 102 during the combustion process. In another manner, the calculated energy (E) may be based on an accumulated fuel flow. The accumulated fuel flow may be an integral of the mass of fuel injected into the engine 102 during the combustion process.

The diagnostic module 206 calculates a temperature-energy ratio (R) based on the temperature delta (ΔT), the calculated energy (E), and an adjustment factor (α):

$$R=(\Delta T_{ECT-RCT})/E^{\alpha}$$

The diagnostic module 206 compares the ratio (R) to a failure threshold to determine whether the thermostat 132 is stuck open.

The adjustment module 208 determines the adjustment factor (α). Ideally, as previously stated, the heat energy (Q) transferred to the coolant mass (m) is proportional to an increase in temperature of the coolant mass (m). However, the calculated energy (E) is based on the chemical potential energy of the mass of air and mass of fuel. Therefore, the calculated energy (E) includes both the kinetic energy and the heat energy. The adjustment factor (α) may modify the calculated energy (E) to correspond to the heat energy transferred to the coolant mass. The adjustment factor (α) may be a calibrateable constant based on testing of multiple similar engines. For example, a statistically determined value of about 0.6 may be used.

The adjustment factor (α) may also be based on changes in the coolant mass (m). For example, when the heater request is present, the coolant mass (m) may be larger due to the addition of the heater coolant mass ($m_h$). The adjustment factor (α) may be increased or decreased to adjust the calculated energy (E) for the changes in the coolant mass (m).

The adjustment factor (α) may also be based on the transfer of the heat energy to the exhaust over a predetermined time. A portion of the heat energy may be transferred to the exhaust, which may increase a temperature of the exhaust manifold 117. The heat energy transferred to the exhaust manifold 117 may decrease as the temperature of the exhaust manifold increases. The heat energy transferred to the coolant mass (m) may increase as the temperature of the exhaust manifold 117 increases. The adjustment factor (α) may be increased or decreased based on the change in the transfer of the heat energy from the exhaust manifold 117 to the coolant mass (m).

In another manner, the adjustment factor (α) may be based on an operating condition of the engine 102 such as when the ECT is below a predetermined temperature. As the ECT increases, the heat energy transferred to the coolant mass (m) may decrease. Similarly, the adjustment factor (α) may be based on the intake air temperature measured by the IAT sensor 109. A portion of the heat energy may be transferred from the engine 102 to the ambient air around the engine 102. Therefore, the adjustment factor (α) may be increased or decreased based on the ECT and/or the IAT.

When the thermostat 132 is closed, the ECT increases due to the heat energy transferred to the coolant mass (m) while the RCT remains substantially constant inside the radiator 126. Therefore, the temperature delta (ΔT) increases. As the combustion process continues, the mass airflow continues to accumulate, thus increasing the calculated energy (E). The temperature delta (ΔT) increases and the calculated energy (E) increases, causing the ratio (R) to remain above the failure threshold.

When the thermostat 132 is stuck open, the temperature delta (ΔT) may not increase during the combustion process. The ECT and the RCT may increase at substantially the same rate because the same coolant mass (m) circulates through the engine 102 and the radiator 126. Therefore, the temperature delta (ΔT) remains substantially constant. As the combustion process continues the calculated energy (E) increases. The ratio (R) will decrease below the failure threshold as the temperature delta (ΔT) remains constant and the calculated energy (E) increases.

The diagnostic module 206 compares the ratio (R) to a failure threshold to determine if the thermostat 132 is stuck open. The comparison may occur multiple times during the combustion process. For example, the comparison may occur once per second. While the ratio (R) is greater than or equal to the failure threshold, the thermostat 132 is not stuck open. While the ratio (R) is less than or equal to the failure threshold, the thermostat 132 is stuck open.

The results of the comparison may be filtered. For example, a failure rate may be determined based on a failure counter (X) and a test counter (Y). The failure counter (X) may increment while the thermostat 132 is stuck open. With each comparison, the test counter (Y) may increment. When the failure rate (X/Y) is above a threshold rate, the ECM 110 outputs a failure status indicating a stuck open thermostat. The diagnostic module 206 may perform the comparison for a predetermined time during the combustion process. In another manner, the diagnostic module 206 may perform the comparison while the IAT and/or ECT are below a predetermined temperature threshold.

Figure 3:
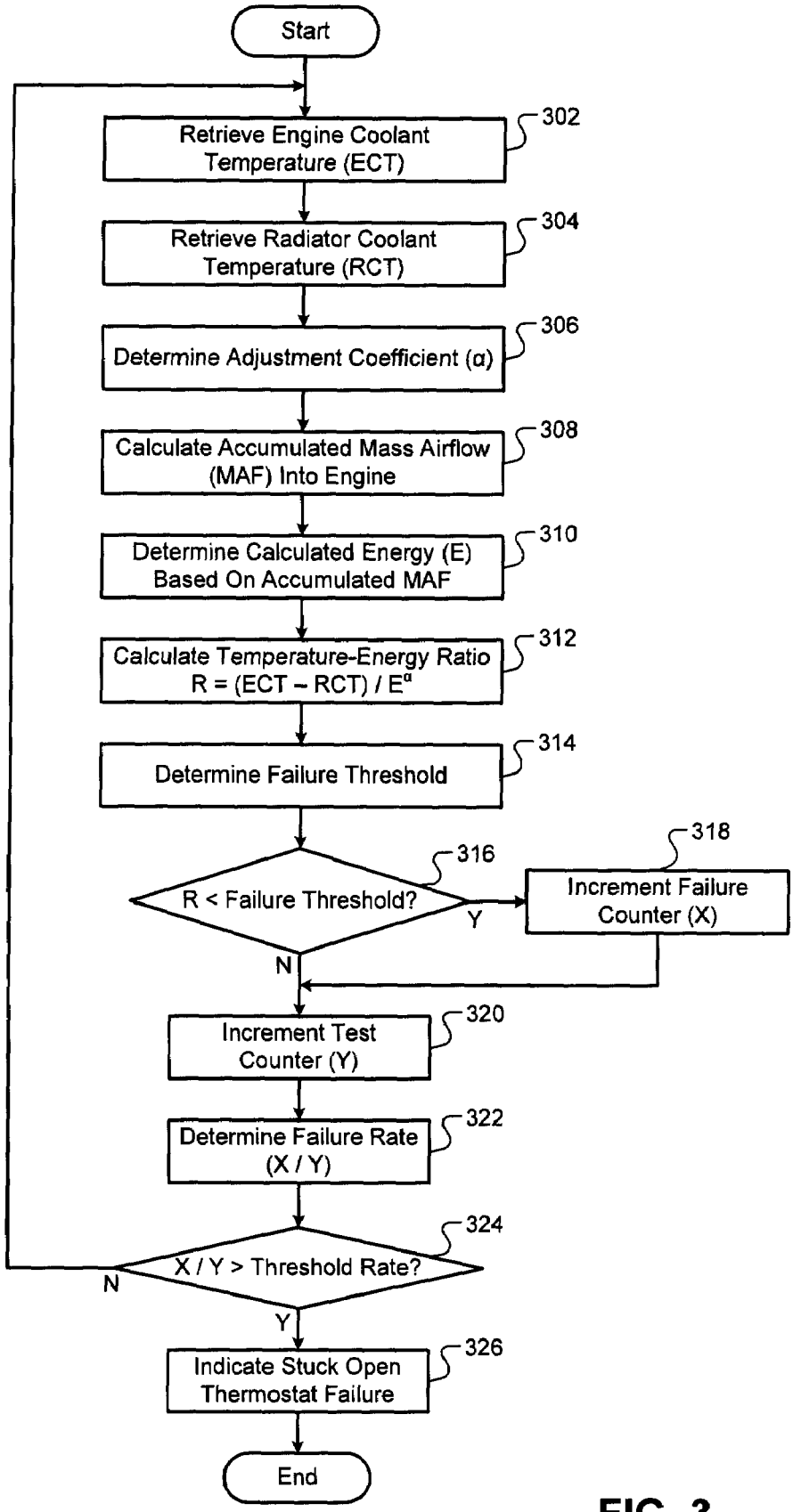
FIG. 3 is a flowchart depicting exemplary steps performed in the engine control module.

Referring now to FIG. 3, a flowchart depicts exemplary steps of an engine control system. Control begins in step 302 during the combustion process when control determines the engine coolant temperature (ECT). In step 304, control determines the radiator coolant temperature (RCT). Control determines the adjustment factor (α) in step 306.

In step 308, control calculates the accumulated mass airflow into the engine 102 based on a signal from the MAF sensor 108. Control determines the calculated energy (E) based on the accumulated mass airflow from the MAF sensor 108 in step 310. In step 312, control calculates the temperature-energy ratio (R). In step 314, control determines the failure threshold for a stuck open thermostat.

In step 316, control determines whether the ratio (R) is less than the failure threshold. While the ratio (R) is less than the failure threshold, the failure counter (X) increments in step 318. In step 320, the test counter (Y) increments. In step 322, control determines the failure rate (X/Y). If the failure ratio (X/Y) is greater than the threshold rate in step 324, control indicates a stuck open thermostat failure in step 326. Otherwise, control may continue to step 302.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system comprising:

a temperature comparison module that generates a temperature difference between an engine coolant temperature and a radiator coolant temperature;

an energy determination module that determines an energy value corresponding to heat energy generated by an engine, wherein the heat energy increases at least one of the engine coolant temperature and the radiator coolant temperature; and a diagnostic module that generates a comparison of the temperature difference and the energy value and determines a status of a thermostat associated with the engine based on the comparison.

2. The engine control system of claim 1, wherein the comparison includes determining a ratio of the temperature difference to the energy value, and wherein the diagnostic module determines that the status is open when the ratio is less than or equal to a failure threshold.

3. The engine control system of claim 2, wherein the diagnostic module determines that the status is closed when the ratio is greater than the failure threshold.

4. The engine control system of claim 1, wherein the energy value is based on a mass of air entering the engine.

5. The engine control system of claim 1, wherein the energy value is based on a mass of fuel injected into the engine.

6. The engine control system of claim 1, further comprising an adjustment module that determines an adjustment factor for selectively adjusting the energy value, wherein the adjustment factor is based on at least one of the engine coolant temperature, the radiator coolant temperature, a heater request, an engine run time, and an intake air temperature.

7. A method comprising:

generating a temperature difference between an engine coolant temperature and a radiator coolant temperature;

determining an energy value corresponding to heat energy generated by an engine, wherein the heat energy increases at least one of the engine coolant temperature and the radiator coolant temperature; and generating a comparison of the temperature difference and the energy value and determining a status of a thermostat associated with the engine based on the comparison.

8. The method of claim 7, further comprising determining a ratio of the temperature difference to the energy value wherein the status is open when the ratio is less than or equal to a failure threshold.

9. The method of claim 8, further comprising determining that the status is closed when the ratio is greater than the failure threshold.

10. The method of claim 7, further comprising determining the energy value based on a mass of air entering the engine.

11. The method of claim 7, further comprising determining the energy value based on a mass of fuel injected into the engine.

12. The method of claim 7, further comprising determining an adjustment factor for selectively adjusting the energy value, wherein the adjustment factor is based on at least one of the engine coolant temperature, the radiator coolant temperature, a heater request, an engine run time, and an intake air temperature.

* * * * *